US008672506B2

(12) United States Patent
Chen

(10) Patent No.: US 8,672,506 B2
(45) Date of Patent: Mar. 18, 2014

(54) SOLAR CANDLE LIGHT INSERT MODULE

(75) Inventor: Chi Gon Chen, Guang Zhou (CN)

(73) Assignee: International Development LLC, Roanoke, TX (US)

( * ) Notice: Subject to any disclaimer, the term of this patent is extended or adjusted under 35 U.S.C. 154(b) by 342 days.

(21) Appl. No.: 13/237,590

(22) Filed: Sep. 20, 2011

(65) Prior Publication Data

US 2013/0070446 A1 Mar. 21, 2013

(51) Int. Cl.
*F21L 13/00* (2006.01)

(52) U.S. Cl.
USPC ..... 362/183

(58) Field of Classification Search
USPC ..... 362/183, 157, 360, 362
See application file for complete search history.

(56) References Cited

U.S. PATENT DOCUMENTS

| | | | |
|---|---|---|---|
| 3,890,085 | A | 6/1975 | Andeweg |
| 3,942,940 | A | 3/1976 | O'Shea |
| 4,177,407 | A | 12/1979 | Goldstein et al. |
| 4,675,578 | A | 6/1987 | Mitchell et al. |
| 5,065,291 | A | 11/1991 | Frost et al. |
| 5,255,170 | A | 10/1993 | Plamp et al. |
| D347,906 | S | 6/1994 | Dorick |
| 5,404,343 | A | 4/1995 | Boggio |
| 5,564,816 | A | 10/1996 | Arcadia et al. |
| 5,980,064 | A | 11/1999 | Metroyanis |

*Primary Examiner* — Vip Patel
(74) *Attorney, Agent, or Firm* — Brian E. Harris

(57) ABSTRACT

A decorative lighting device that provides a solar powered light insert module that is adaptable to a wide variety of tubular decorative lightshades. More specifically, the solar powered lighting insert of the present invention provides a solar powered lighting fixture having one or more light emitting diodes, which flicker so as to emulate the light of a candle flame. The housing is designed so as to be slideably coupled with a wide variety of decorative votive candle lightshades.

21 Claims, 6 Drawing Sheets

SOLAR CANDLE LIGHT INSERT MODULE

BACKGROUND OF THE INVENTION

1. Technical Field of the Invention

The present invention pertains to portable solar powered light systems; more particularly the present invention pertains to a solar powered insert configured in a votive light assembly.

2. Description of the Related Art

Decorative votive or vigil lights are known to be used for various purposes in both indoor and outdoor applications. In the past, such votive lights normally include a cup-shaped candle holder for receiving a votive candle. The candle holder may be either transparent or opaque and oftentimes includes a decorative cutout on its sidewall.

Traditionally, the votive candle is a small wax candle dimensioned to fit within the candle holder. An example of indoor votive light is described and illustrated in U.S. Pat. No. 3,942,940. One of the problems with such votive light assemblies is that the wax candle burns out in a relatively short time, typically less than a day. Due to the limited life of votive candles when lit, electronic votive lights for indoor applications have been developed, for example, as disclosed in U.S. Pat. Nos. 3,890,085; 4,177,407; and 4,675,578.

Votive lights are also known to be used in outdoor applications. Both candle and electronic outdoor votive lights are known. An example of an electronic outdoor votive light is disclosed in U.S. Pat. No. D347,906. U.S. Pat. No. 5,980,064 discloses a votive light assembly, which includes a battery-powered integral light emitting diode (LED). U.S. Pat. Nos. 5,065,291; 5,255,170; and 5,564,816 disclose other types of electronic illuminated memorials, normally found at cemeteries. In addition U.S. Pat. No. 5,404,343 discloses a cemetery memorial with an audio system. Such outdoor electronic devices utilize solar cells in order to power the illumination or audio assembly within the device. However, such prior art light assemblies are typically constructed as a large integrated unit. That is, the lighting element and the holder element are configured as a unified whole. Thus, the lighting element is typically inseparable from the holder/housing unit. Moreover, the constant light produced from the single LED employed is easily distinguishable from that produced by a flickering candle.

Thus, there is a need for providing a votive light which stays lit for a substantial amount of time and is quickly and easily adapted to a wide varieties of votive light designs.

SUMMARY OF THE INVENTION

The decorative lighting device of the present invention provides a solar powered light insert module that is adaptable to a wide variety of decorative votive candle lightshades. More specifically, the solar powered lighting insert of the present invention provides a solar powered lighting fixture having one or more light emitting diodes, which flicker so as to emulate the light of a candle flame. The housing is designed so as to be slideably coupled with a wide variety of decorative votive candle lightshades.

In a preferred embodiment, the light insert module comprises a shell housing dimensioned to resemble the shape of a votive candle. The bottom of the light insert module features a solar panel for gathering solar energy while the top portion is dimensioned to resemble a candle flame of a standard lighted wax candle.

The light insert module includes a self-contained electrical system, which includes a solar panel, an electrical storage device (e.g., a battery) and electrical circuitry including one or more light emitting diodes and a printed circuit board, which is programmed to cause light generated by the LED to flicker so as to emulate the light of a candle flame.

The electrical circuitry is designed so that the electrical storage device may be a standard battery or a rechargeable battery. When a standard battery is installed, the electrical circuitry is designed to turn off the circuit's electrical flow from the solar panel to avoid explosion or burning. The electrical circuitry may also include an on/off switch.

BRIEF DESCRIPTION OF THE DRAWINGS

A more complete understanding of the method and apparatus of the present invention may be had by reference to the following detailed description when taken in conjunction with the accompanying drawings, wherein.

Figure 1:
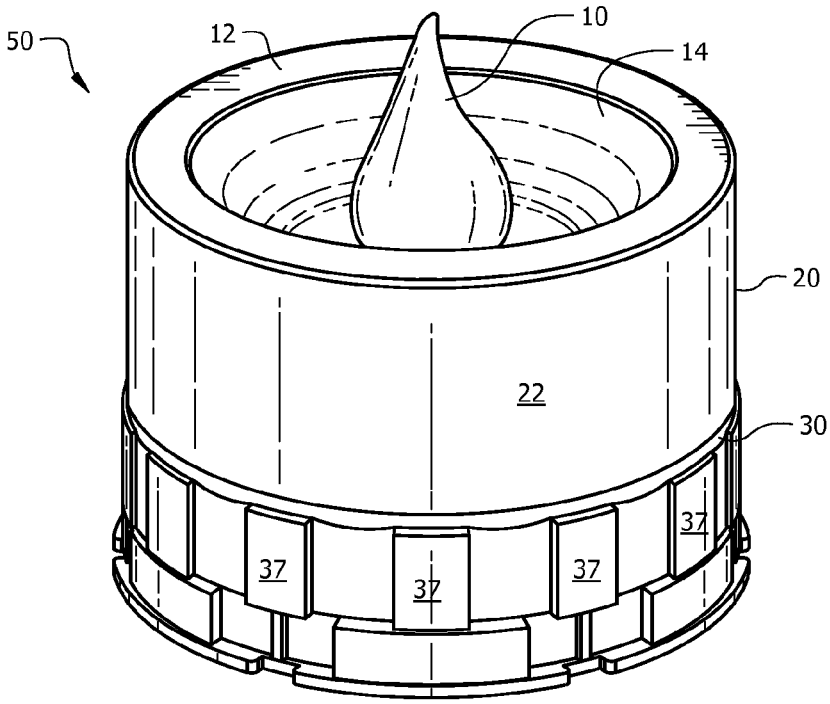
FIG. 1 is a top perspective view of an embodiment of the light insert module of the present invention.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 2:
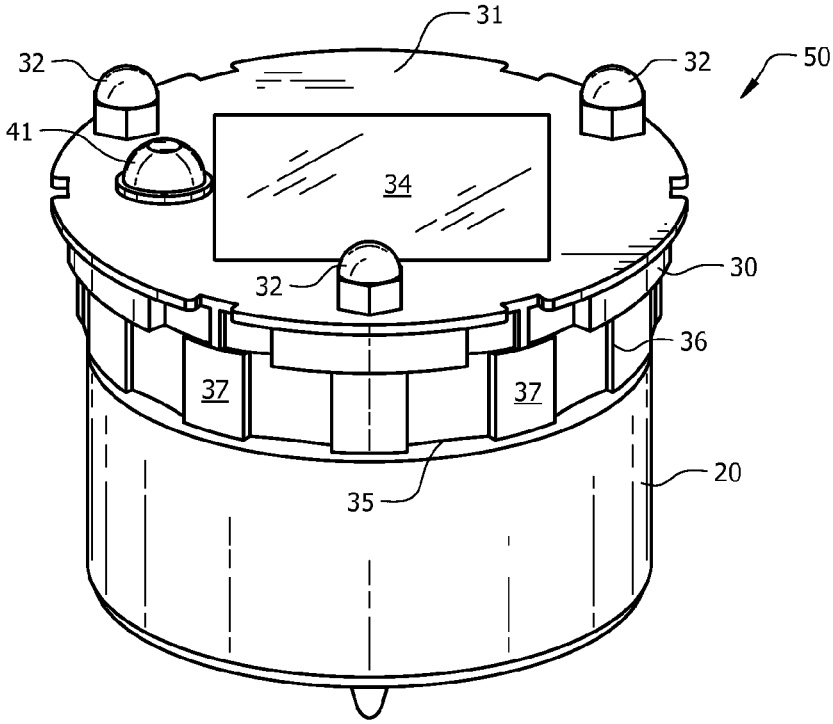
FIG. 2 is a bottom perspective view of the embodiment of the light insert module of the present invention shown in FIG. 1.
Figure 3:
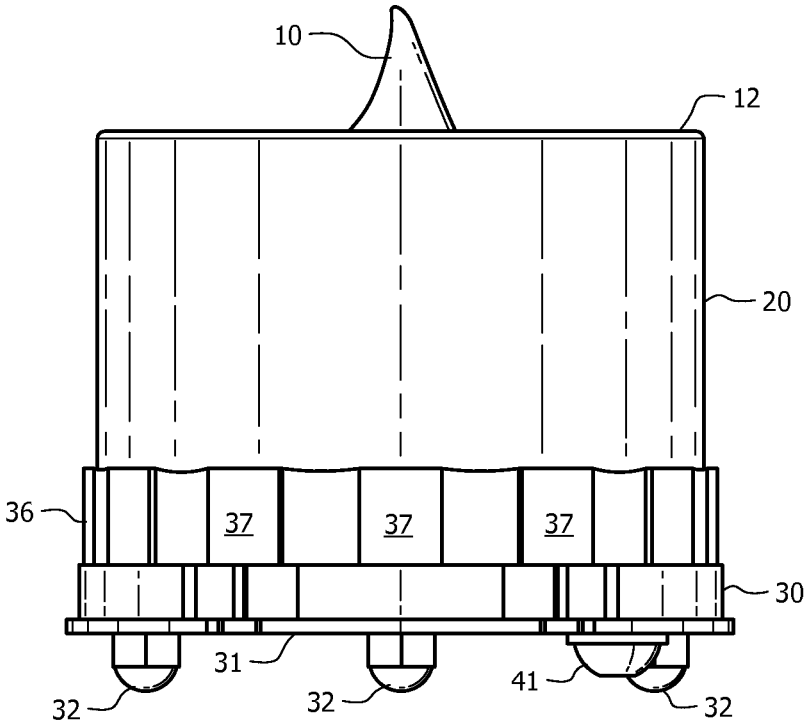
FIG. 3 is a side elevation view of the embodiment of the light insert module of the present invention shown in FIG. 1.

As may be seen in FIGS. 1-3, a preferred embodiment of the light insert module 50 of the present invention is depicted. The light insert module 50 typically has a short tubular housing having an outer circumference which is complementary to the inside circumference rim 62 of the decorative lightshade 60. While the preferred embodiment of the light insert module 50 of the present invention is dimensioned to resemble a standard wax votive candle, it is understood any number of cross-sectional shapes (e.g., circular, square, elliptical, polygonal) are adaptable to the invention.

The light insert module 50 is comprised of an upper or top housing shell 20 that is slideably coupled (i.e., friction fit) with a lower or base housing shell 30. The housing shells are preferably formed of a thin, yet strong translucent thermal plastic material. The cylindrical upper or top housing shell 20 includes an annular sidewall portion 22 that is open on one end and substantially closed on an opposing end. The open end of the shell 20 is designed to slidably engage a complementarily dimensioned annular sidewall 33 of the lower or base housing shell 30. In a preferred embodiment, the upper or top shell housing 20 further includes an additional annular sidewall 24 configured within the annulus of the outer sidewall 22 so that the annular sidewall 33 of the lower or base housing shell 30 fits between the inner 24 and outer 22 sidewalls of the upper or top housing shell 20 when slideably coupled together.

The upper or top shell housing 20 may further include a rim 12 and concavity 14 formed in the closed top portion. A flame-shaped diffuser element 10 may also be configured in the bottom of the concave region 14 of the top shell housing. Light emitting diodes (LEDs) positioned on the inside of the hollow flame-shaped diffuser element 10 simulate the ambiance of a flickering candle flame when energized. The upper housing shell 20 and flame-shaped diffuser element 10 may be constructed as a single piece or as two-piece assembly wherein the flame-shaped diffuser element 10 is rotatively coupled with an aperture (not shown) formed in the bottom of the concavity 14 of the upper housing shell 20.

The lower or base housing shell 30 includes an annular sidewall 33 extending from a substantially closed bottom or base surface 31. A friction band 36 is configured about the lower portion 35 of the annular sidewall 33 near the bottom surface 31 of the base housing shell 30. The friction band 36 includes a series of friction pads 37 having a greater thickness so as to extend further away from the outer periphery of the annular sidewall 33. The circumference of the outer peripheries of the annular sidewalls 33, 22 of the light insert module 50 are generally designed to be complementary, yet smaller than the inside circumference rim 62 of a selected decorative lightshade 60. The friction pads 37 are dimensioned so as to provide a friction fit with the inside circumference rim 62 of a selected decorative lightshade 60. Preferably, the friction band 36 comprises a flexible, stretchable band that fits tightly about the annular sidewall 33 of the lower housing shell 30.

The bottom surface 31 of the base housing shell 30 includes a solar panel 34 configured therein, that enables the electrical system to receive solar energy when exposed to sunlight. The bottom surface 31 may further include a plurality of feet 32 extending therefrom, which provide some protection to the exposed solar panel. The bottom surface 31 may also include access to an on/off switch 41 to the electrical system.

Figure 4:
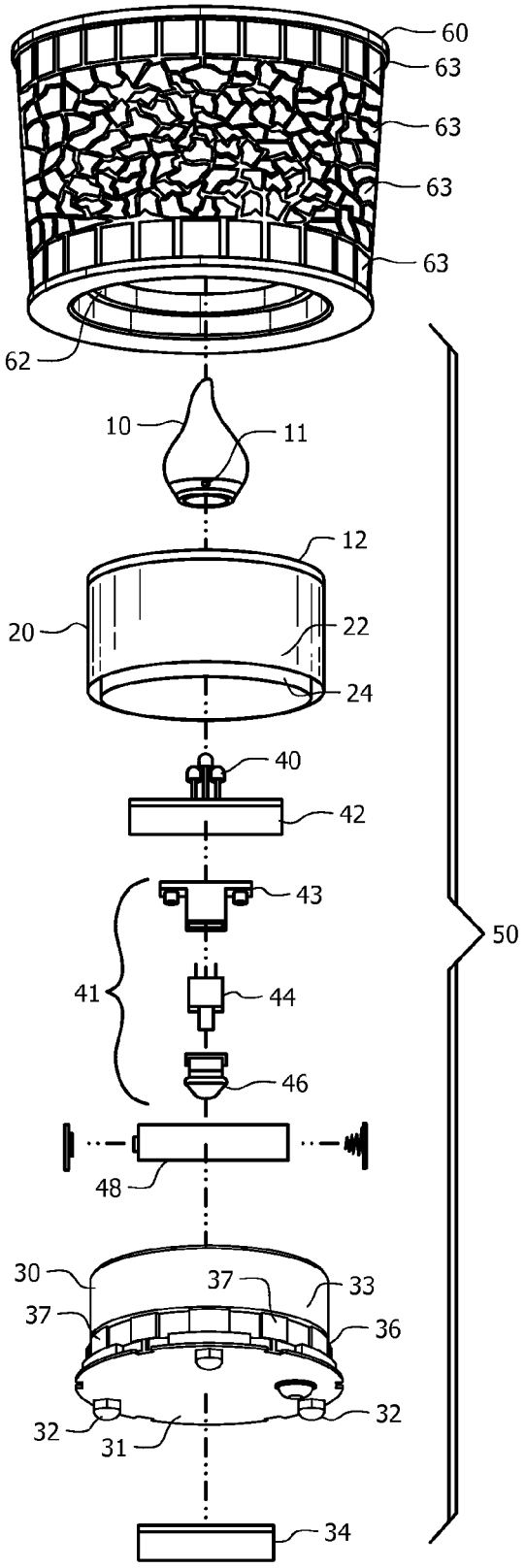
FIG. 4 is an exploded perspective view of the embodiment of the light insert module of the present invention shown in FIG. 1 with an embodiment of a votive lightshade.

With reference now to FIG. 4, an exploded view of an embodiment of the light insert module 50 of the present invention is shown in line with a corresponding embodiment of a decorative lightshade 60. In the depicted embodiment, the decorative lightshade 60 is generally tubular, being open at both ends. Alternatively, it is understood that the end opposing the end receiving the light insert module 50 may be closed. The opening at the bottom end is generally dimensioned to receive the light insert module 50 and includes a rim having an inside circumference 62 that is dimensioned to frictionally engage the friction pads 37 of the friction band 36 configured about the periphery of the light insert module 50. In a preferred embodiment depicted in the figures, the decorative lightshade 60 comprises a thin plastic shell having a plurality glass shards 63 attached to its exterior surface.

Figure 5:
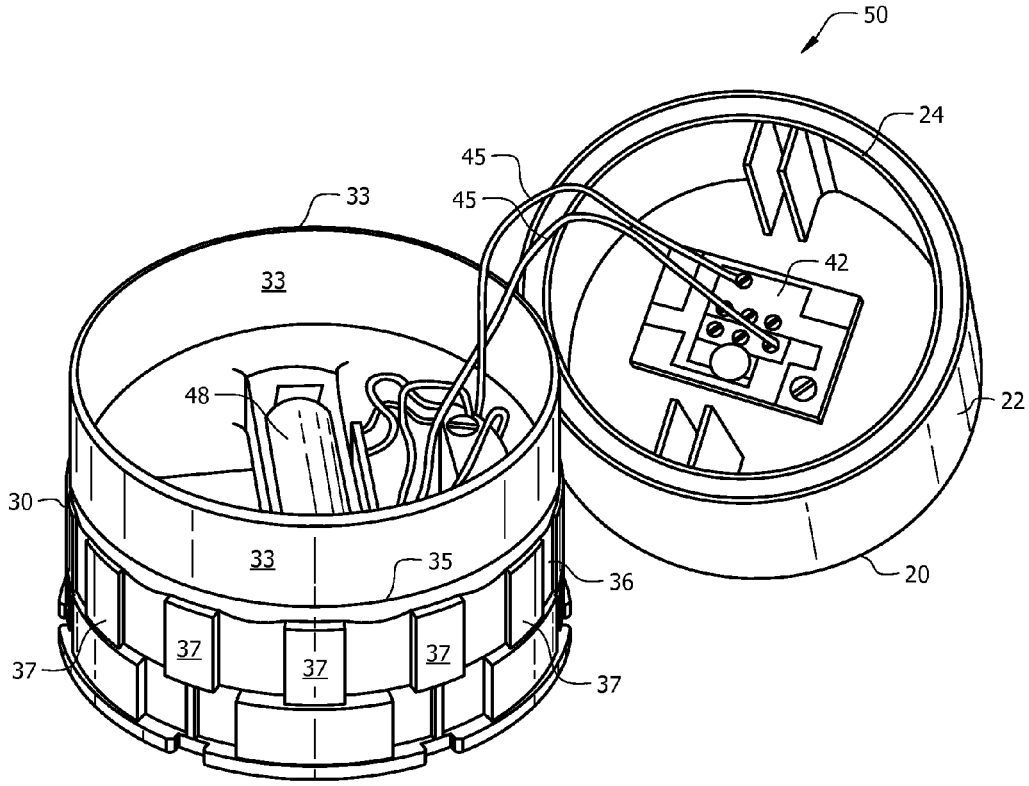
FIG. 5 is a perspective view of the embodiment of the light insert module of the present invention shown in FIG. 1 showing the top shell housing disengaged from the bottom or base shell housing.

As shown in FIG. 4 and further in FIG. 5, electrical components of the light insert module 50 are configured within the interior chamber of the upper 20 and lower 30 housing shells. For example, an electrical storage device (e.g., battery 48) and the on/off electrical switch 44 are configured in the lower or base housing shell 30. The electrical storage device is electrically coupled with the previously noted solar panel 34, configured on the bottom surface of the base housing shell 30.

Similarly, one or more light emitting diodes (LEDs) 40 extending from a printed circuit board (PCB) 42 are configured in the upper or top housing shell 20 and electrically coupled by means of wiring 45 with the electrical components in the lower or base housing shell 30. In a preferred embodiment, the PCB 42 is fixably attached to the inside of the top of the upper or top housing shell 20 so that the plurality of LEDs 40 extend through an aperture formed in the bottom of the convavity 14 of the upper housing shell 20 and into a hollow recess or chamber formed in the flame-shaped diffuser element 10.

Figure 6:
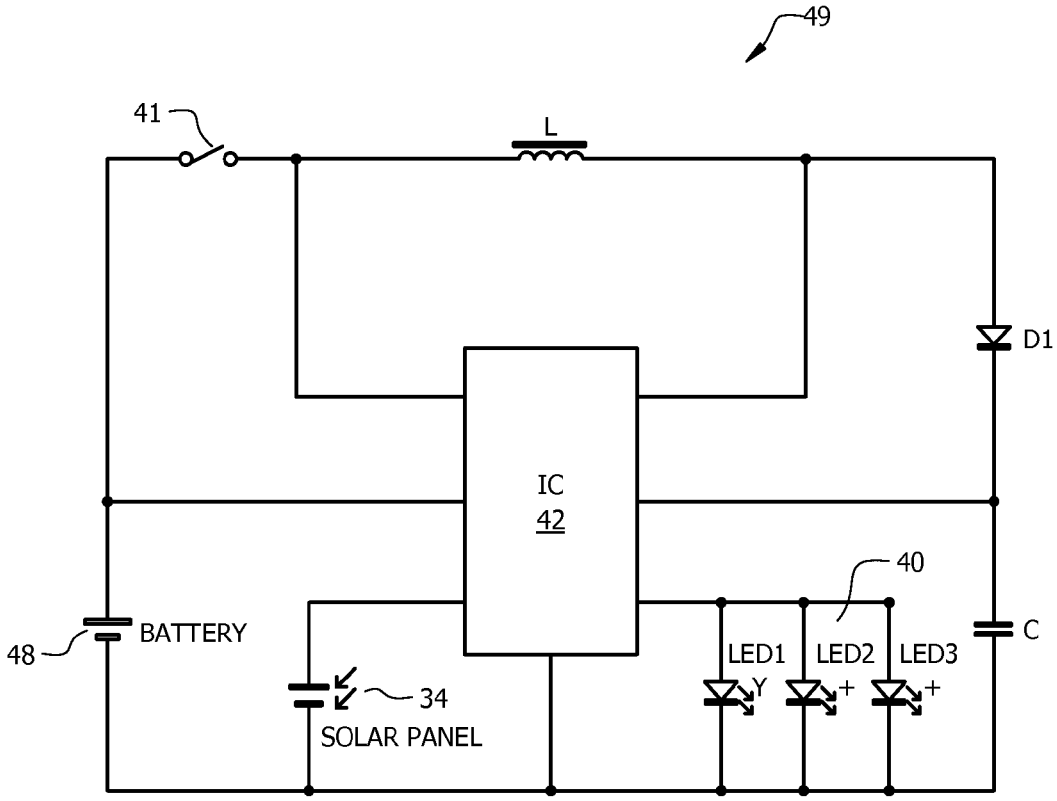
FIG. 6 is an electrical schematic diagram of an embodiment of the outdoor light of the present invention illustrating the full recommended circuit incorporating an LED light assembly.

With reference now to FIG. 6, a schematic of an electrical circuit 49, constructed in accordance with the depicted embodiment of the present invention, is provided. The exemplary circuit 49 is comprised of transistors configured on a printed circuit board 42, capacitors C, inductance coil L, on/off switch 41, one or more light emitting diodes (LEDs) 40 and an electrical storage device (e.g., battery 48) coupled to the solar panel 34 configured on the bottom surface 31 of the base housing shell 30. The circuit may also include a light sensor (not shown) to activate the LEDs 40 when a certain level of light is detected.

The integrated circuit on the printed circuit board 42 may include circuitry which causes the plurality of LEDs 40 to flicker when energized. This can be accomplished in any number of ways. For example, the voltage may be modulated for each LED in a random pattern so that the level of brightness changes intermittently. Alternatively, the electrical current delivered to each LED 40 may be varied over time causing changes in brightness.

The electrical circuitry 49 of the present invention may also be designed so that the electrical storage device may be a standard battery or a rechargeable battery. When a standard battery is installed, the integrated circuit on the printed circuit board 42 senses that a standard battery is in place that is unsuitable for recharging. The integrated circuit on the printed circuit board 42 correspondingly turns off the circuit's electrical flow from the solar panel to avoid explosion or burning. The electrical circuitry may also include an on/off switch.

Figure 7:
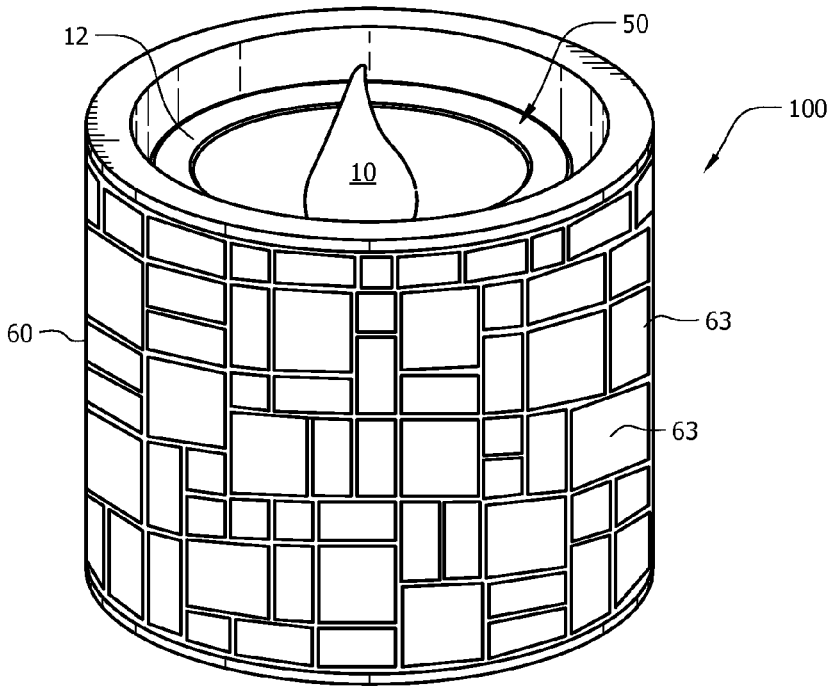
FIG. 7 is a top perspective view of the embodiment of the light insert module of the present invention shown in FIG. 1 properly inserted and engaged in a variant embodiment of a votive lightshade.
Figure 8:
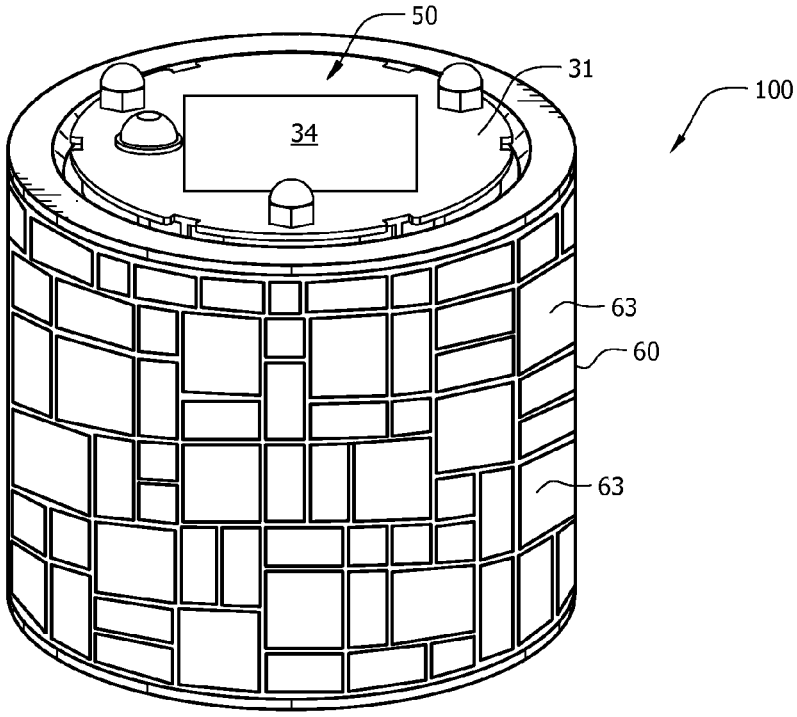
FIG. 8 is a bottom perspective view of the embodiment of the light insert module and votive lightshade shown in FIG. 7.

With reference now to FIGS. 7-8, an embodiment of the lighting device 100 of the present invention is shown. The lighting device 100 includes a light insert module 50 of the present invention is engaged in a corresponding embodiment of a decorative lightshade 60. FIG. 7 depicts the invention in the "use" mode, wherein the light insert module 50 of the present invention is slidably coupled with a decorative votive candle lightshade 60. In a preferred embodiment, the sidewall of the lightshade 60 is substantially translucent so that when the plurality of LEDs 40 are energized the generated light project through all of the surfaces emulating the look and sensory feel of a classic votive candle. FIG. 8 depicts the invention in a "recharge" mode, wherein decorative votive candle lightshade 60 and the light insert module 50 engaged therein are turned upside down from the position depicted in FIG. 7 so that the solar panel 34 on the bottom surface 31 of the base shell housing 30 may be exposed to the maximum amount of sunlight. When the electrical storage device (e.g., battery 48) is fully recharged, the decorative votive candle lightshade 60 and the light insert module 50 may be turned right-side-up as depicted in FIG. 7.

Those of ordinary skill in the art will understand that one insert may be used for a wide variety of decorative lightshade designs. Moreover, the length of component housing shells 30, 20 may be extended or retracted to fit a wide variety of lightshades of various heights.

It will now be evident to those skilled in the art that there has been described herein an improved solar powered light insert module. Although the invention hereof has been described by way of a preferred embodiment, it will be evident that other adaptations and modifications can be employed without departing from the spirit and scope thereof. For example, the solar powered light insert module of the present invention could be dimensioned as a square or rectilinear cylinder. The terms and expressions employed herein have been used as terms of description and not of limitation; and thus, there is no intent of excluding equivalents, but on the contrary it is intended to cover any and all equivalents that may be employed without departing from the spirit and scope of the invention.

I claim:

1. A light insert module for a lightshade, comprising:

an upper housing shell having a first annular sidewall that is open on one end and substantially closed on an opposing end;

a lower housing shell having a second annular sidewall extending from a closed base surface that complements said first annular sidewall, said second sidewall having a friction band configured about its exterior circumference;

wherein when said first and second annular sidewalls are slidably engaged, said friction band extends away from said second annular sidewall to engage a complementarily-shaped rim opening of the lightshade.

2. The light insert module of claim 1, further comprising a self-contained electrical system configured in a chamber formed between said upper and lower housing shells.

3. The light insert module of claim 2, further comprising a solar panel configured in said closed base surface and electrically connected to said electrical system.

4. The light insert module of claim 3, further comprising a plurality of feet extending from the exterior of said closed base surface.

5. The light insert module of claim 3, wherein said self-contained electrical system comprises an electrical circuit having an electrical storage device and a plurality of light emitting diodes.

6. The light insert module of claim 5, wherein said electrical circuit further comprises a printed circuit board and an on/off switch.

7. The light insert module of claim 6, wherein said printed circuit board includes a programmable integrated circuit.

8. The light insert module of claim 7, wherein the integrated circuit causes the plurality of light emitting diodes to flicker in brightness intensity.

9. The light insert module of claim 7, wherein the integrated circuit senses whether the electrical storage device is rechargeable or not.

10. The light insert module of claim 9, wherein when the integrated circuit senses that the electrical storage device is rechargeable, electrical energy generated by the solar panel is allowed to flow to said electrical storage device.

11. The light insert module of claim 9, wherein when the integrated circuit senses that the electrical storage device is not rechargeable, electrical energy generated by the solar panel is not allowed to flow to said electrical storage device.

12. The light insert module of claim 1 wherein the substantially closed end of the upper housing shell includes a concavity and rim formed therein.

13. The light insert module of claim 12 further comprising a flame-shaped diffuser element configured in the bottom of the concavity.

14. The light insert module of claim 1 wherein the upper and lower housing shells are constructed of a translucent thermal plastic material.

15. A lighting device, comprising:

a tubular lightshade having an opening rim on one end;

a light insert module having a cross-section that is complementary to a cross-section of the opening rim of said tubular lightshade, said light insert module comprising:

an upper housing shell having a first annular sidewall that is open on one end and substantially closed on an opposing end;

a lower housing shell having a second annular sidewall extending from a closed base surface that complements said first annular sidewall, said second sidewall having a friction band configured about its exterior circumference;

wherein when said first and second annular sidewalls are slidably engaged, said friction band extends away from said second annular sidewall to engage the opening rim of the lightshade.

16. The lighting device of claim 14, wherein said cross-sections of said light insert module and said opening rim of the tubular lightshade are substantially circular.

17. The lighting device of claim 14, wherein said cross-sections of said light insert module and said opening rim of the tubular lightshade are substantially elliptical.

18. The lighting device of claim 14, wherein said cross-sections of said light insert module and said opening rim of the tubular lightshade are substantially polygonal.

19. The lighting device of claim 14, wherein said tubular lightshade comprises a plastic tube covered with shards of glass.

20. The lighting device of claim 14, wherein said tubular lightshade is open at both ends.

21. The lighting device of claim 14, wherein said tubular lightshade is closed on end opposing said opening rim end.

* * * * *